US008584638B2

(12) United States Patent
Scheidig

(10) Patent No.: US 8,584,638 B2
(45) Date of Patent: Nov. 19, 2013

(54) DEVICE FOR VARIABLY ADJUSTING THE CONTROL TIMES OF GAS EXCHANGE VALVES OF AN INTERNAL COMBUSTION ENGINE

(75) Inventor: Gerhard Scheidig, Oberasbach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 13/511,468

(22) PCT Filed: Nov. 24, 2010

(86) PCT No.: PCT/EP2010/068082

§ 371 (c)(1),
(2), (4) Date: May 23, 2012

(87) PCT Pub. No.: WO2011/064231

PCT Pub. Date: Jun. 3, 2011

(65) Prior Publication Data

US 2012/0266834 A1 Oct. 25, 2012

(30) Foreign Application Priority Data

Nov. 27, 2009 (DE) ..... 10 2009 056 018

(51) Int. Cl.
*F01L 1/34* (2006.01)

(52) U.S. Cl.
USPC ..... 123/90.17; 123/90.15

(58) Field of Classification Search
USPC ..... 123/90.15, 90.17, 90.31
See application file for complete search history.

(56) References Cited

U.S. PATENT DOCUMENTS

| | | | | |
|---|---|---|---|---|
| 5,107,804 | A | 4/1992 | Becker et al. | |
| 5,263,443 | A | 11/1993 | Schechter et al. | |
| 6,186,104 | B1 | 2/2001 | Torii et al. | |
| 7,444,971 | B2 * | 11/2008 | Suga et al. | 123/90.17 |
| 2007/0017463 | A1 | 1/2007 | Mott et al. | |
| 2009/0133652 | A1 | 5/2009 | Fujyoshi et al. | |

FOREIGN PATENT DOCUMENTS

| | | |
|---|---|---|
| DE | 19850947 | 11/2000 |
| DE | 102008002461 | 12/2009 |
| EP | 0806550 | 11/1997 |
| EP | 1598528 | 11/2005 |
| EP | 1783334 | 5/2007 |
| EP | 2075421 | 7/2009 |
| WO | 2008067935 | 6/2008 |

* cited by examiner

*Primary Examiner* — Zelalem Eshete
(74) *Attorney, Agent, or Firm* — Volpe and Koenig, P.C.

(57) ABSTRACT

A camshaft adjuster (11) for a camshaft (35), by which cylinder valves (12) of an internal combustion engine are actuated, wherein through the use of the camshaft (35) late torques act on the camshaft adjuster (11) in a direction of later cylinder valve opening times when the cam is running-on, and opposing early torques act on the camshaft adjuster (11) in a direction of earlier opening times when the cam is running-off. The feeding and draining of pressure medium can be controlled by a control unit (20), wherein a torque mode or a pump mode can be selectively adjusted by the control unit (20), wherein primarily camshaft torques are used for building up pressure in the first partial chamber A or in the second partial chamber B in the torque mode, while the pressure build-up in the first partial chamber A or in the second partial chamber B in the pump mode is primarily by pressure medium provided by a pressure medium pump P.

9 Claims, 21 Drawing Sheets

DEVICE FOR VARIABLY ADJUSTING THE CONTROL TIMES OF GAS EXCHANGE VALVES OF AN INTERNAL COMBUSTION ENGINE

FIELD OF THE INVENTION

The invention relates to a device for variably adjusting the timing of gas exchange valves of an internal combustion engine, having a hydraulic phase adjustment unit, wherein the phase adjustment unit can be placed in drive connection with a crankshaft and with a camshaft and has at least one advance chamber and at least one retardation chamber, to and from which pressure medium can be supplied and discharged via pressure medium lines, wherein a phase position of the camshaft relative to the crankshaft can be adjusted by means of a supply of pressure medium to the adjustment chambers.

BACKGROUND

In modern internal combustion engines, devices for variably adjusting the timing of gas exchange valves are used to enable variable configuration of the phase position of a camshaft relative to a crankshaft within a defined angular range between a maximum advanced position and a maximum retarded position. For this purpose, a hydraulic phase adjustment unit of the device is integrated into a drive train via which torque is transmitted from the crankshaft to the camshaft. This drive train can be implemented for example as a belt, chain or gear drive. The phase adjustment speed and the pressure medium requirement are significant parameters of such devices. To enable the phase position to be adapted in an optimum manner to the various driving situations, high phase adjustment speeds are desirable. In the context of measures for reducing consumption, there is furthermore a demand for an ever smaller pressure medium requirement so as to enable the pressure medium pump of the internal combustion engine to be of smaller design or to enable the delivery rate to be reduced when using regulated pressure medium pumps.

A device of this type is known for example from EP 0 806 550 A1. The device comprises a vane-type phase adjustment unit with a drive input element, which is in drive connection with the crankshaft, and a drive output element, which is connected to the camshaft for conjoint rotation therewith. A plurality of pressure spaces is formed within the phase adjustment unit, wherein each of the pressure spaces is divided into two oppositely acting pressure chambers by means of a vane. The vanes are moved within the pressure spaces by means of a supply of pressure medium to or discharge of pressure medium from the pressure chambers, which brings about a change in the phase position between the drive output element and the drive input element. In this case, the pressure medium required for phase adjustment is provided by a pressure medium pump of the internal combustion engine and is directed selectively to the advance or retardation chambers by means of a control valve. The pressure medium flowing out of the phase adjustment unit is directed into a pressure medium reservoir, the oil sump of the internal combustion engine. Phase adjustment is thus accomplished by means of the system pressure provided by the pressure medium pump of the internal combustion engine.

A further device is known for example from U.S. Pat. No. 5,107,804 A. In this embodiment, the phase adjustment unit is likewise of the vane type, and a plurality of advance and retardation chambers is provided. In contrast to EP 0 806 550 A1, phase adjustment is not accomplished by supplying pressure medium to the pressure chambers by means of a pressure medium pump; instead, alternating moments acting on the camshaft are used. The alternating moments are caused by the rolling movements of the cams on the gas exchange valves, each of which is preloaded by a valve spring. In this case, the rotary motion of the camshaft is braked during the opening of the gas exchange valves and accelerated during closure. These alternating moments are transmitted to the phase adjustment unit, with the result that the vanes are periodically subjected to a force in the direction of the retardation stop and of the advance stop. As a result, pressure peaks are produced alternately in the advance chambers and the retardation chambers. If the phase position is supposed to be held constant, pressure medium is prevented from flowing out of the pressure chambers. In the case of a phase adjustment in the direction of earlier timing, pressure medium is prevented from flowing out of the advance chambers, even at times at which pressure peaks are being produced in the advance chambers. If the pressure in the retardation chambers rises owing to the alternating moments, this pressure is used to direct pressure medium out of the retardation chambers into the advance chambers, using the pressure of the pressure peak generated. Phase adjustment in the direction of later timing is accomplished in a similar way. In addition, the pressure chambers are connected to a pressure medium pump, although only to compensate for leaks from the phase adjustment unit. Phase adjustment is thus accomplished by diverting pressure medium out of the pressure chambers to be emptied into the pressure chambers to be filled, using the pressure of the pressure peak generated.

Another device is known from US 2009/0133652 A1. In this embodiment, phase adjustment in the case of small alternating moments is accomplished, in a manner similar to the device in EP 0 806 550 A1, by supplying pressure to the advance chambers or the retardation chambers by means of a pressure medium pump while simultaneously allowing pressure medium to flow out of the other pressure chambers to the oil sump of the internal combustion engine. In the case of high alternating moments, these are used, as in the device in U.S. Pat. No. 5,107,804 A, to direct the pressure medium under high pressure out of the advance chambers (retardation chambers) into the retardation chambers (advance chambers). During this process, the pressure medium expelled from the pressure chambers is fed back to a control valve, which controls the supply of pressure medium to or discharge of pressure medium from the pressure chambers. The pressure medium passes via check valves within the control valve to the inlet port, which is connected to the pressure medium pump, wherein some of the pressure medium is expelled into the pressure medium reservoir of the internal combustion engine.

EP 2 075 421 A1 discloses a valve for a camshaft adjuster. The valve comprises a valve piston which is arranged in a rotatable manner in a valve housing. Inlets and outlets for pressurized oil are arranged such that, by adjusting the valve piston, pressurized oil can be conducted to the adjustment chambers and to a locking mechanism. Here, the locking mechanism can be activated not only in an end position of the camshaft adjuster, that is to say at a stop in the retarded or advanced position, but also in an intermediate position. This permits mid-position locking, which may be expedient depending on the engine application.

DE 198 50 947 presents a device for controlling the timing of an internal combustion engine, having at least one drive means, at least one camshaft with cams, at least one hydraulically actuable adjustment unit for adjusting the angle of relative rotation between the drive means and the camshaft, at least one hydraulic fluid supply device for charging the adjustment unit, and at least one positive control unit by means of which the hydraulic charging of the adjustment unit can be influenced at least at times and/or at least in part as a function of the absolute angle of rotation of the camshaft and/or of the cams. Here, a flow connection to the adjustment chambers is shut off in a targeted manner when pressure fluctuations caused by torques arise which would be imparted back to the adjustment chambers by the camshaft when cams are running on or running off.

U.S. Pat. No. 6,186,104 B1 discloses a vane-type valve timing control device for an internal combustion engine, in which, between the pressure cells and the control valve which actuates them, there is connected a pressure distributor device which serves to suppress disturbance camshaft torques. For this purpose, for example during a retardation, the oil supply to the pressure cells is shut off when an advance torque arises. Conversely, during an advance, the oil supply to the pressure cells is shut off when a retardation torque arises. Similarly to DE 198 50 947, therefore, a return swing of the adjustment unit is suppressed owing to the adjustment of opposing camshaft torques.

SUMMARY

The invention is based on the object of providing a device for variably adjusting the timing of gas exchange valves of an internal combustion engine, which device, while exhibiting a high phase adjustment speed, should have a lower oil requirement.

The objective is met according to the invention by specifying a camshaft adjuster for a camshaft which serves to actuate cylinder valves of an internal combustion engine, wherein retardation torques in the direction of retarded cylinder valve opening times are imparted back to the camshaft adjuster by the camshaft when cams are running on, and oppositely directed advance torques in the direction of advanced cylinder valve opening times are imparted back to the camshaft adjuster by the camshaft when cams are running off, having a pressure chamber and having an adjusting means arranged in the pressure chamber, wherein the adjusting means divides the pressure chamber into a first chamber part and a second chamber part, wherein pressure medium can be supplied to the first and the second chamber part and pressure medium can be discharged from the first chamber part and second chamber part, such that the adjusting means can be moved by a pressure difference between the first chamber part and second chamber part, resulting in a rotation of the camshaft, wherein, when a relatively high pressure prevails in the first chamber part, the camshaft is rotated in the direction of advanced cylinder valve opening times, and when a relatively high pressure prevails in the second chamber part, the camshaft is rotated in the direction of retarded cylinder valve opening times, and wherein the supply and discharge of pressure medium can be controlled by means of a control device, wherein a torque mode or a pump mode can be selectively set by means of the control device, wherein in the torque mode, predominantly camshaft torques are utilized to build up pressure in the first chamber part or in the second chamber part, whereas in the pump mode, the pressure build-up in the first chamber part or in the second chamber part is realized predominantly by means of pressure medium provided by a pressure medium pump.

In the prior art, two strategies have hitherto been followed for hydraulic camshaft adjustment: firstly, a provision of pressure medium by means of a pressure medium pump, generally an oil pump of an engine oil lubricating circuit, or a utilization of camshaft torques for generating the required adjustment pressure. The first strategy is also referred to as "oil pressure actuated" (OPA) and the second is referred to as "cam torque actuated" (CTA). The invention is now based on the realization that respective advantages of OPA and CTA methods can be expediently combined with one another as a function of an operating state of the internal combustion engine. In operating states in which a high pump pressure of the pressure medium pump is provided, the pump mode, that is to say an OPA method, is expediently selected, whereas in the event of low pump pressures but high camshaft torques, the torque mode, that is to say the CTA method, is used. Here, it is self-evidently possible for an adjustment in the CTA method to be assisted by the pressure medium pump in addition to the utilization of the camshaft torques, and vice versa.

Here, the invention is not restricted to a particular design of camshaft adjuster, that is to say, for example, use may be made of a vane-type adjuster in which multiple pairs of chamber parts are formed, wherein the adjustment means is a vane which divides the chamber parts and which is for example formed in one piece from a rotor or plugged into said rotor.

The control device preferably comprises a valve piston which is arranged in a valve housing, wherein the valve piston is rotatable and axially displaceable relative to the valve housing, wherein the torque mode or the pump mode can be set by means of axial relative displacement of the valve piston with respect to the valve housing, whereas the supply and discharge of pressure medium to and from the chamber parts can be controlled by means of relative rotation of the valve piston with respect to the valve housing.

The switching positions for the pump mode and torque mode are thus realized in a structurally simple manner by means of an axial displacement of the valve piston relative to the valve housing. In a respective axial switching position, the actual regulation of the adjustment, that is to say the supply and discharge of pressure medium to and from the chamber parts, is then possible by means of a rotation of the valve piston relative to the valve housing. It is advantageous if, for the axial displacement, the valve piston is moved relative to a positionally fixed cylinder head, for example by means of a magnet and a restoring spring, whereas the relative rotation is performed by the valve housing, which rotates for example together with the camshaft. This embodiment is used in particular in a preferred central valve configuration in which the control valve, formed from valve piston and valve housing, of the control device is arranged centrally in the camshaft adjuster and furthermore preferably simultaneously, as a screw, connects said camshaft adjuster to the camshaft. In a further preferred embodiment, the restoring spring of the valve piston is in the form of a compression spring and mounted by means of rolling bearings with respect to the valve housing, or is in the form of a tensile spring and connected directly or indirectly to the magnet.

It is preferable for first orifices and second orifices to be arranged in the valve housing so as to be distributed over the circumference of the valve housing, wherein the first orifices correspond with the second chamber part and the second orifices correspond with the first chamber part, and wherein the surface of the valve piston forms an orifice cover such that the first orifices and second orifices can be at least partially closed off by the orifice cover in accordance with the axial position and angular position of the valve piston relative to the valve housing. The orifice cover is thus for example a surface which is situated radially further outward than the rest of the valve piston body and which adjoins the valve housing.

It is furthermore preferable for the first orifices and the second orifices to be arranged relative to one another on the circumference at an angular interval, in each case spaced apart uniformly, and arranged in the correct phase with respect to the orifice cover, such that a relative rotation of the valve piston with respect to the valve housing by the angular interval leads to a geometrically identical arrangement. It is furthermore preferable for the orifice cover to be designed so as to be adapted with regard to an asymmetrical displacement of camshaft torques in relation to the zero line. Such an asymmetrical displacement occurs in particular as a result of a friction torque which acts on the camshaft in the retardation direction in an angle-independent manner. In this way, the approximately sinusoidal curve of the camshaft profile is thus displaced, as a whole, by a magnitude corresponding to the friction torque. It may thus be advantageous for the respective local widths of the orifice cover to be adapted to the now shortened or lengthened effective times of an advance or retardation torque. For example, an orifice cover illustrated in a "developed" view would no longer correspond to a symmetrical rectangular waveform curve with maximum and minimum phases of equal length, but rather would have in each case different lengths for the maximum and minimum phases.

This arrangement makes it possible in particular, without further structural measures such as for example check valves, for an adjustment process coordinated with the camshaft torques to be carried out solely on the basis of the geometric arrangement of the valve housing and valve piston. Since the camshaft torques arise in a fixed geometrical phase position owing to the arrangement of the cams, it is for example possible through corresponding arrangement of the orifices and orifice cover to achieve that, in a CTA method mode, torques acting in the correct direction for an adjustment are utilized by virtue of orifices being opened up, and torques acting in the wrong direction for an adjustment are suppressed by virtue of orifices being closed.

It is preferable for the orifice cover to be formed from a first cover part for the first orifices and a second cover part for the second orifices, wherein the first cover part and the second cover part have in each case an edge situated axially at the outside on the valve piston and an axially inner edge, wherein the inner edges have an approximately crown-like profile in the circumferential direction with an axial position which alternates along the circumference.

The inner edges thus run for example in a zigzag-like manner, a crown-like manner or in the form of a rectangular waveform curve in the circumferential direction, that is to say the inner edges run at a first axial position in regions and at an axially spaced apart position in further regions. This makes it possible, by means of the orifice cover, for the orifices in the valve housing to be entirely or partially opened up or blocked as a function of the relative rotation of valve piston and valve housing. Here, as described above, said opening up and blocking is geometrically coupled to the phase position of the camshaft torques.

It is preferable if, for the relative axial position of the valve piston, five switching positions can be set, wherein in a first position, the pump mode is set for an adjustment of the camshaft in the direction of retarded cylinder valve opening times, in the second, axially subsequent switching position, the torque mode is set for an adjustment of the camshaft in the direction of advanced cylinder valve opening times, in the third, axially subsequent switching position, a camshaft adjustment is blocked, in the fourth, axially subsequent switching position, the torque mode is set for an adjustment of the camshaft in the direction of retarded cylinder valve opening times, and in the fifth, axially subsequent switching position, the pump mode is set for an adjustment of the camshaft in the direction of advanced cylinder valve opening times.

These five switching positions thus generally yield adequate adjustment possibilities, in a manner adapted to the respective engine operating state. For example: whereas, when there is adequate pressure from the pressure medium pump, a retardation of the camshaft takes place in switching position one and an advance takes place in switching position five, it is possible in the case of low pressure, utilizing the camshaft torques, for a retardation to take place in switching position two and an advance to take place in switching position four. The middle position, switching position three, can be utilized for a blocking of the adjustment.

These five switching positions are preferably realized as follows:

Preferably, in the first switching position, upon the occurrence of retardation torques, a relative angular position of the valve housing and valve piston is set such that the first orifices are predominantly opened up by the orifice cover for a supply of pressure medium from the pressure medium pump, while the second orifices are open for a discharge of pressure medium, wherein, upon the occurrence of advance torques, a relative angular position of the valve housing and valve piston is set such that the first orifices are opened up by the orifice cover for a supply of pressure medium from the pressure medium pump, while the second orifices are opened up for a supply of pressure medium from the pressure medium pump and simultaneously for a discharge of pressure medium.

Preferably, in the second switching position, upon the occurrence of advance torques, a relative angular position of the valve housing and valve piston is set such that the second orifices are predominantly opened up by the orifice cover for a supply of pressure medium from the first chamber part and the first orifices are open for a discharge of pressure medium from the first chamber part into the second chamber part, wherein, upon the occurrence of retardation torques, a relative angular position of the valve housing and valve piston is set such that the second orifices are blocked by the orifice cover, while the first orifices are substantially opened up for a supply of pressure medium from the pressure medium pump.

Preferably, in the third switching position, a relative angular position of the valve housing and valve piston is set such that the first orifices are blocked by the orifice cover upon the occurrence of advance torques and the second orifices are blocked by the orifice cover upon the occurrence of retardation torques.

Preferably, in the fourth switching position, upon the occurrence of retardation torques, a relative angular position of the valve housing and valve piston is set such that the first orifices are predominantly opened up by the orifice cover for a supply of pressure medium from the second chamber part, while the second orifices are open for a discharge of pressure medium from the second chamber part into the first chamber part, wherein, upon the occurrence of advance torques, a relative angular position of the valve housing and valve piston is set such that the first orifices are blocked by the orifice cover, while the second orifices are substantially opened up for a supply of pressure medium from the pressure medium pump.

Preferably, in the fifth switching position, upon the occurrence of advance torques, a relative angular position of the valve housing and valve piston is set such that the second orifices are predominantly opened up by the orifice cover for a supply of pressure medium from the pressure medium pump, while the first orifices are open for a discharge of pressure medium, wherein, upon the occurrence of retardation torques, a relative angular position of the valve housing and valve piston is set such that the first orifices are opened up by the orifice cover for a supply of pressure medium from the pressure medium pump and simultaneously for a discharge of pressure medium, while the second orifices are opened up for a supply of pressure medium from the pressure medium pump.

The feature, specified for the above switching positions, of an orifice being predominantly opened up means that the predominant part of its cross section is not blocked by the orifice cover. This corresponds to an intensely dethrottled state. This embodiment is not imperatively necessary but rather is merely a preferred embodiment, in particular with the advantage that, owing to the substantially unrestricted pressure medium throughflow, there is no risk of air induction. In this way, hydraulic rigidity is ensured, and the generation of disturbing noises is also prevented. In contrast to conventional systems in which an axial displacement of a control piston generally causes an orifice to be opened up to a continuously increasing extent corresponding to the axial actuating movement, the rotation of the orifice cover over or away from a relatively large orifice in the valve housing results in the abrupt opening-up of a large cross section, and therefore the desired dethrottling.

BRIEF DESCRIPTION OF THE DRAWINGS

Further features of the invention will emerge from the following description and from the drawings, which illustrate exemplary embodiments of the invention in simplified form. In the drawings.

DETAILED DESCRIPTION OF THE PREFERRED EMBODIMENTS

Figure 1:
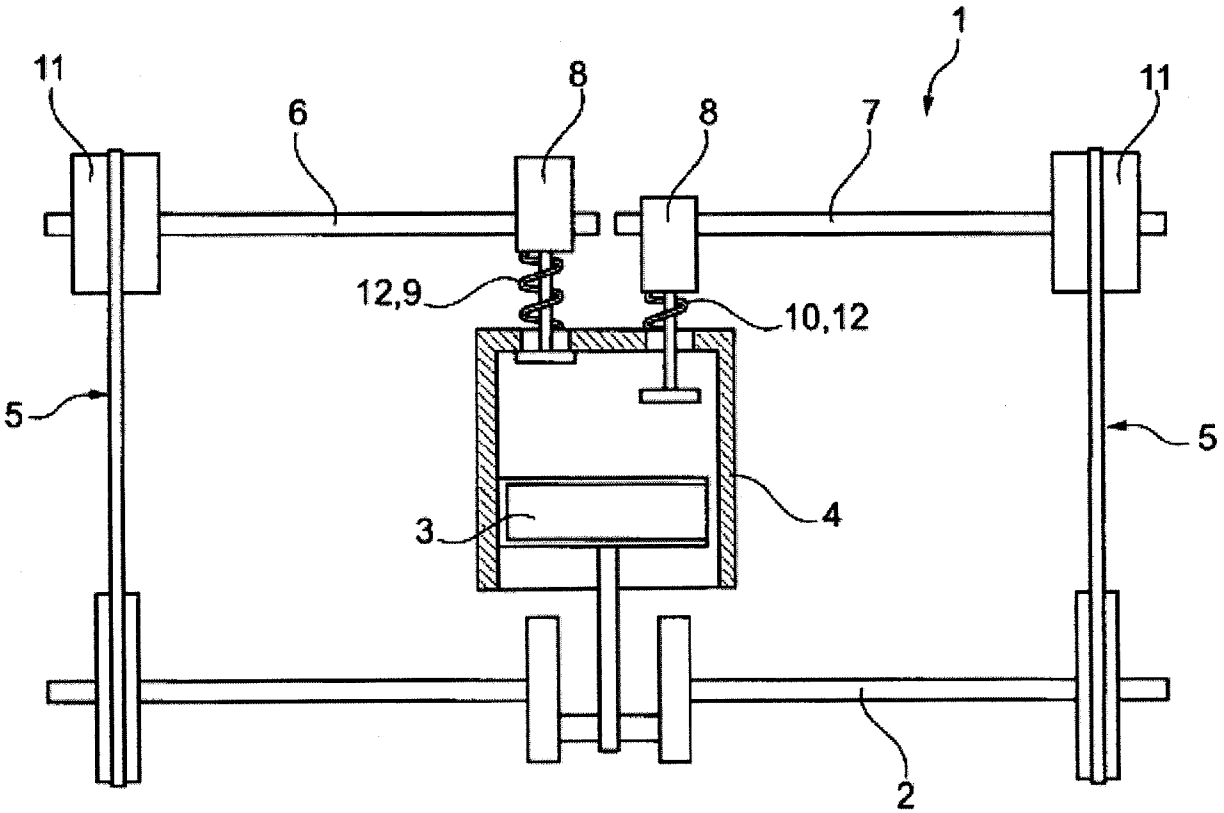
FIG. 1 shows, highly schematically, an internal combustion engine.

FIG. 1 illustrates an internal combustion engine 1, with a piston 3 which is connected to a crankshaft 2 being indicated in a cylinder 4. In the illustrated embodiment, the crankshaft 2 is connected via in each case one traction mechanism drive 5 to an intake camshaft 6 and an exhaust camshaft 7, wherein a first and a second camshaft adjuster 11 for variably adjusting the timing of gas exchange valves 9, 10 of an internal combustion engine can effect a relative rotation between the crankshaft 2 and the camshafts 6, 7. Cams 8 of the camshafts 6, 7 actuate one or more intake gas exchange valves 9 or one or more exhaust gas exchange valves 10. The intake gas exchange valves 9 and the exhaust gas exchange valves 10 will hereinafter be referred to for short as cylinder valves 12. It may likewise be provided that only one of the camshafts 6, 7 is equipped with a device 11, or only one camshaft 6, 7 is provided, which is equipped with a camshaft adjuster 11. The intake camshaft 6 and the exhaust camshaft 7 will hereinafter be summarized under the expression "camshaft 35".

Figure 2:
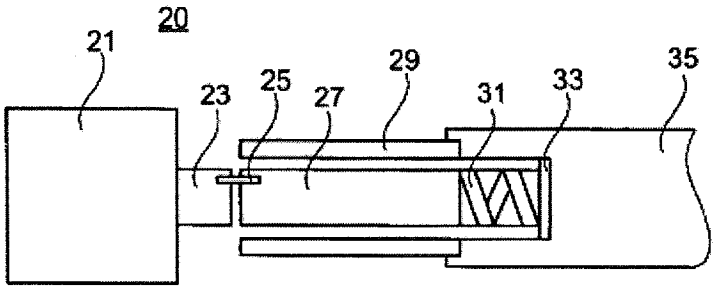
FIG. 2 is a schematic illustration of a control valve.

FIG. 2 is a schematic illustration of a control device 20. The control device 20 comprises a valve housing 29 and a valve piston 27 arranged therein. In the example shown, the control valve 20 is arranged with one end in a camshaft 35. There, the valve piston 27 is acted on by a restoring spring 31. The restoring spring 31 is mounted by means of an axial bearing arrangement 33 in the form of a rolling bearing. The valve piston 27 is connected, at its end remote from the camshaft 35, to a magnet piston 23 which can be moved axially by an electromagnet 21. A rotation prevention means 25 connects the magnet piston 23 to the valve piston 27 such that the latter cannot rotate. It is self-evidently also conceivable for an axial movement to be performed by the valve housing 29 and a rotational movement to be performed by the valve piston 27, with a correspondingly changed configuration of the surroundings.

Figure 3:
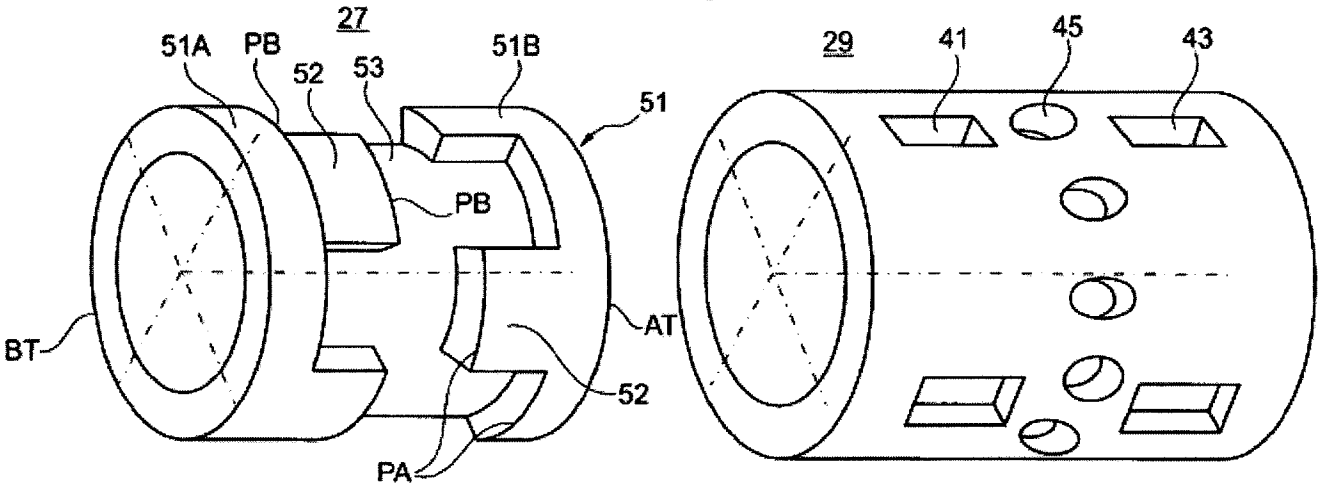
FIG. 3 shows a valve piston and a valve housing.

FIG. 3 shows the valve piston 27 and the valve housing 29 in a perspective view. The valve housing 29 has first orifices 41 distributed about its circumference. Arranged axially offset with respect to the first orifices 41 and approximately in the center of the valve housing 29 are circumferentially distributed third orifices 45. Following these with an axial offset are, in turn, second orifices 43 which are arranged at the same position in the circumferential direction as the first orifices 41. The valve piston 27 is inserted in the correct rotational position into the hollow valve housing 29. The valve piston 27 has, on its surface 53, an orifice cover 51 which is formed by a radially elevated part of the surface 53. The orifice cover has, at one axial end of the valve piston 27, a first cover part 51A, and at the opposite end, a second cover part 51B. The two cover parts 51A, 51B are of crown-like design, that is to say they form a ring around the surface 53 with a respective outer edge BT, AT. The outer edge BT of the first cover part 51A simultaneously forms one axial end of the valve piston 27, whereas the outer edge AT of the second cover part 51B simultaneously forms the other axial end of the valve piston 27. That inner edge PB, PA of the cover parts 51A, 51B which is directed axially toward the center of the surface 53 has a rectangular serration. Here, in each case one crown serration 52 of a cover part 51A, 51B is oriented in the circumferential direction so as to lie between two crown serrations 52 of the other cover part 51B, 51A, wherein there is however an axial spacing between the inner edges PB, PA.

The valve piston 27 should now be arranged in the valve housing 29 in the correct rotational position such that the orifice cover 51 opens up and blocks the first orifices 41 and second orifices 43, respectively, for the correct phase position in each case. A supply of pressure medium to chamber parts of a pressure chamber, and therefore also the adjustment of the phase position of the camshaft, is controlled in this way. This will be explained in detail further below.

Figure 4:
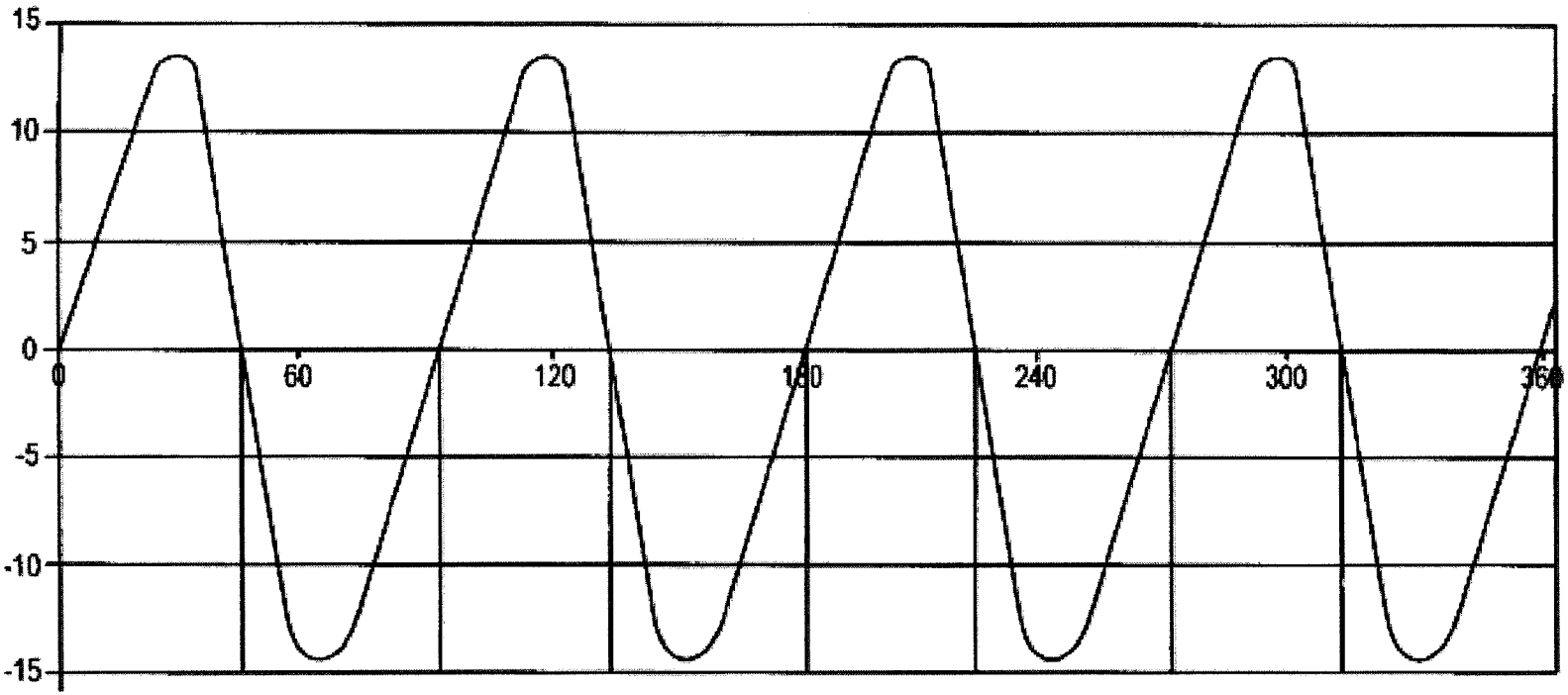
FIG. 4 is an illustration of the camshaft torques as a function of the rotational angle of the camshaft.

FIG. 4 shows, based on the example of a four-cylinder engine, the profile of the camshaft torques, plotted in the y direction, versus the rotational position of the camshaft, plotted in the x direction. A constant torque resulting from friction of the camshaft at a constant rotational speed is neglected here. Camshaft torques greater than zero correspond to a torque in the direction of an advance, that is to say in a direction which leads to earlier opening of the cylinder valves 12. Camshaft torques less than zero correspond to a torque in the direction of a retardation, that is to say in a direction which leads to later opening of the cylinder valves 12. It can be seen that the camshaft torques have an approximately sinusoidal profile as a function of the rotational position of the camshaft. At fixed angular positions in each case, advance torques arise, which alternate with retardation torques. This is now utilized in a targeted manner for the adjustment of the camshaft.

Figure 5:
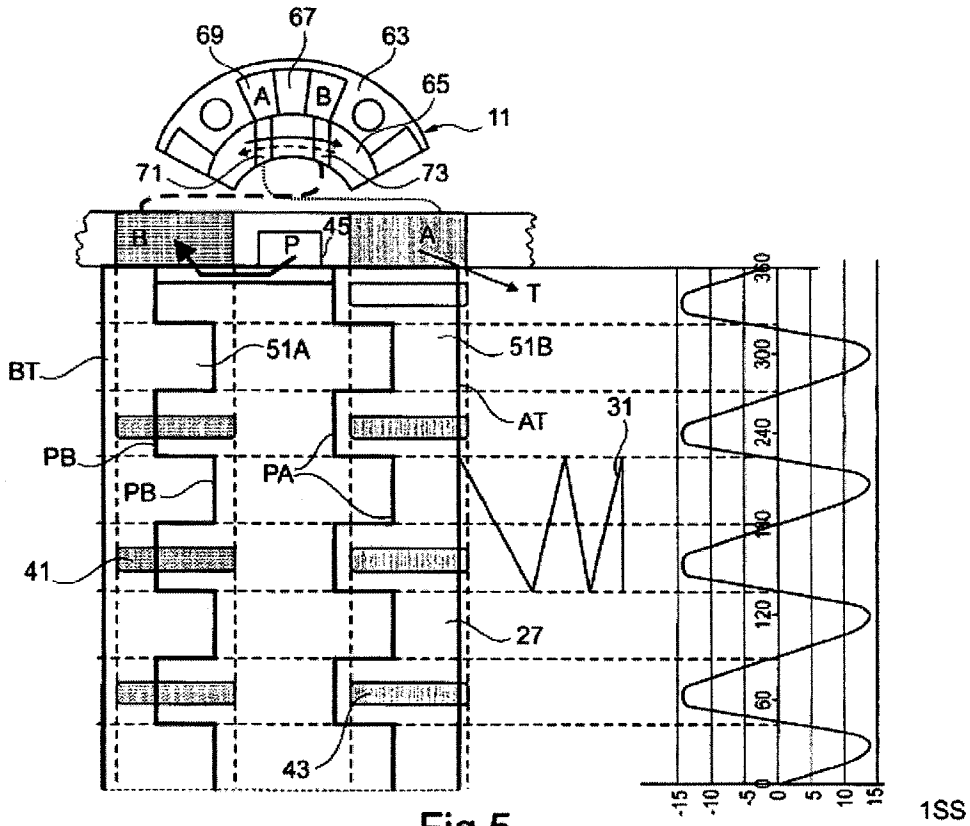
FIGS. 5-14 are schematic illustrations of the different switching positions in the case of an OPA method.

In FIG. 5, a switching position for the adjustment of the camshaft is schematically plotted such that the orifice cover 51 of the valve piston 27 is illustrated in a developed view in a plane. The first cover part 51A thus yields a rectangular profile with the inner edge PB and a straight outer edge BT. Illustrated opposite, then, is the second cover part 51B with the inner edge PA and the outer edge AT. At the outer edge AT, the valve piston 27 is connected to the restoring spring 31, which presses the valve piston 27 against a magnet 21 (not illustrated here).

Also schematically illustrated are the first orifices 41 and the second orifices 43, as they are arranged relative to the orifice cover 51 corresponding to the axial position and rotational position of the valve housing 29 relative to the valve piston 27. The first orifices 41 correspond to a second chamber part B, and the second orifices 43 correspond to a first chamber part A. The chamber parts A, B are divided by a vane 67 which forms an adjustment means 67 and which divides a pressure chamber 69 into the chamber parts A, B. The vane 67 is connected to a rotor 65 of a camshaft adjuster 11. The pressure chamber 69 is formed in a stator 63 of the camshaft adjuster 11. A first oil duct 71 leads to the first chamber part A, a second oil duct 73 leads to the second chamber part B. Only a detail of the camshaft adjuster 11 is shown here. The camshaft adjuster 11 is designed as a vane-type adjuster and has a plurality of pressure chambers, chamber parts, vanes and supply ducts, which are not illustrated here for the sake of clarity.

In the example of FIG. 5, an adjustment of the camshaft takes place in the direction of later opening times of the cylinder valves 12: pressurized oil is supplied to the second chamber part B and is discharged from the first chamber part A. In the switching position shown here, the first cover part 51 substantially opens up the first orifices 41 by means of the inner edge PB, such that pressurized oil passes from a pump P via the third orifices 45 in the valve housing 29 to the second chamber part B. At the same time, the second orifices 43 are opened up slightly by the outer edge AT of the second cover part 51B, such that oil can be discharged from the first chamber part A into a tank T. The pressure difference thus generated between the chamber parts A, B leads to a force being exerted on the vane 67 and therefore on the rotor 65 in a rotational direction to the left. The rotor 65 is connected to the camshaft 35. The camshaft 35 is thus rotated in the "retardation" direction.

As a result of the great extent to which the first orifices 41 are opened up, intense dethrottling is attained, as a result of which the risk of air induction is greatly reduced. Discharge control is realized through the lesser opening-up of the second orifices 43 to the tank.

FIG. 5 shows, on the right adjacent to the schematic illustration of the valve piston 27 and the first and second orifices 41, 43 of the valve housing, the profile, known from FIG. 4, of the camshaft torques as a function of the rotational angle of the camshaft 35. The valve housing 29 and therefore the first and second orifices 41, 43 now rotate in a defined manner relative to said camshaft profile, as shown by the juxtaposition. The first and second orifices in FIG. 5 are therefore precisely synchronous with a retardation camshaft torque. This has the effect that the second orifices 43 receive a pressure peak in the direction of a retardation, as a result of which the oil situated in the first chamber part A can be quickly discharged. Furthermore, the oil pressure of the pump P acts via the widely opened, intensely dethrottled first orifices 41 into the second chamber part B. The result is a very fast adjustment of the camshaft 35. A fast adjustment in the advance direction is also realized in a corresponding way.

Figure 6:
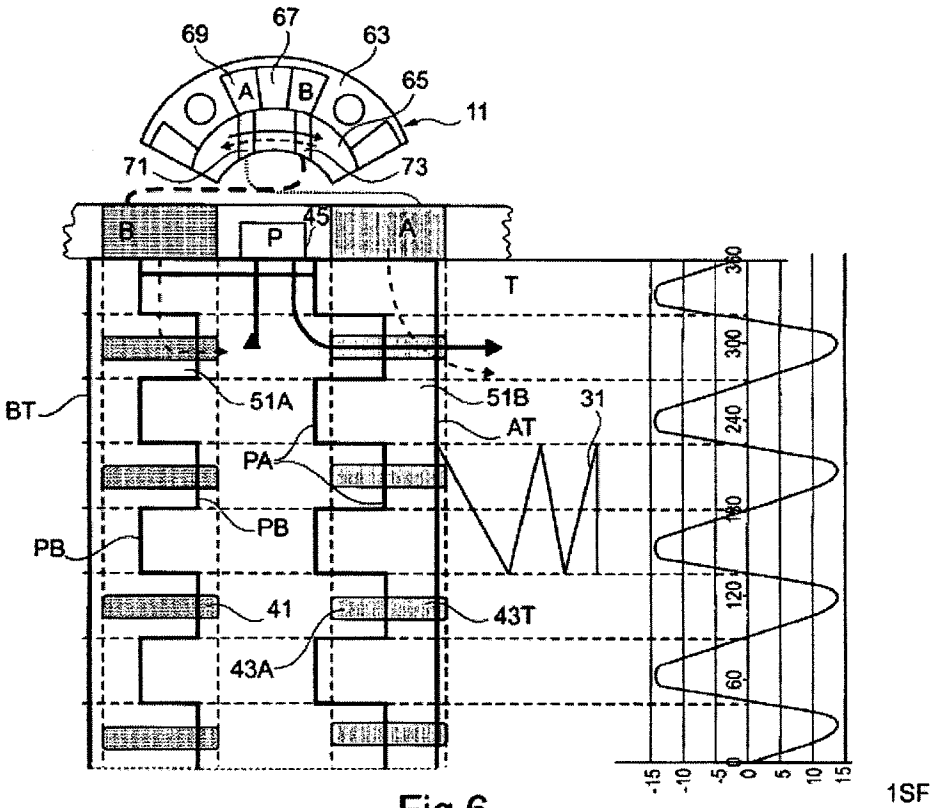

FIG. 6 shows an image corresponding to FIG. 5, but here, the first and second orifices 41, 43 have been rotated relative to the orifice cover 51. This corresponds in terms of time to the occurrence of an advance camshaft torque. The first orifices 41 are opened up only to a small extent by the first cover part 51A, whereas the second orifices 43 are opened up to a great extent for the supply of pressure from the pump P. The pump P acts on both chamber parts A, B. In chamber part B, said pump now acts counter to an advance torque, as a result of which compensation is substantially attained, and no adjustment takes place. Chamber part A is traversed by a flow of pressure medium and emptied into the tank T.

Figure 7:
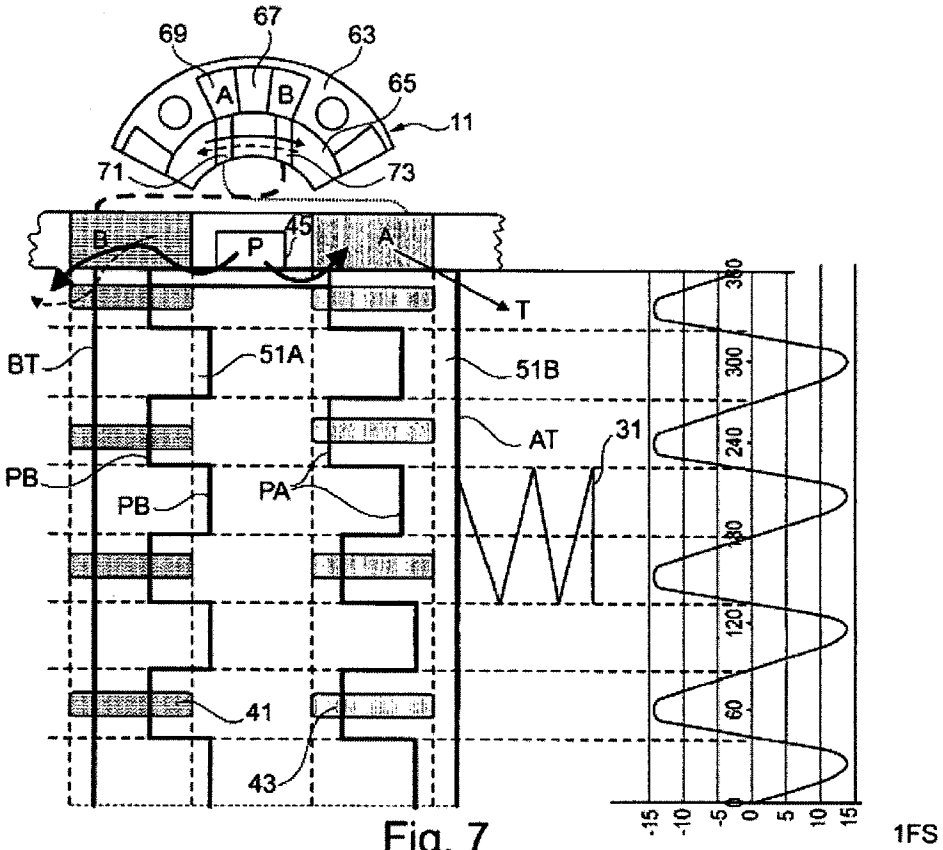
Figure 8:
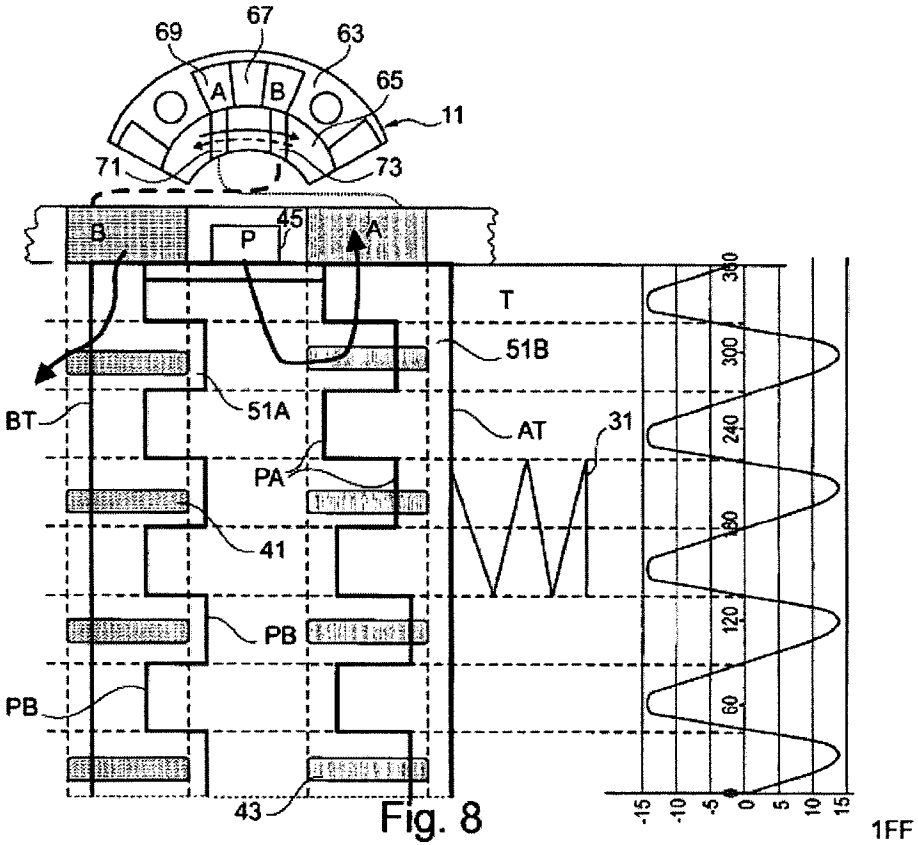

FIGS. 5 and 6 show a switching position for a "retardation" adjustment, in which an adjustment method based on the "oil pressure actuated" (OPA) principle is realized, specifically in a retardation adjustment direction. This switching position, which thus predominantly utilizes the adjustment force of the pump and in which camshaft torques have merely an assisting action, is realized by means of the illustrated axial position of the valve piston 27. The axial switching position is set by means of the magnet 21. In the example shown, this is the basic position without energization of the electromagnet 21. As explained, in the axial switching position, different rotational positions of the valve piston 27 relative to the valve housing 29 are realized, and in this way the corresponding camshaft torques are additionally utilized. FIGS. 7 and 8 show the corresponding illustration for an "advance" adjustment. Here, the actions for the chamber parts A, B are interchanged, but otherwise the explanations made with regard to FIGS. 5 and 6 apply analogously.

Figure 9:
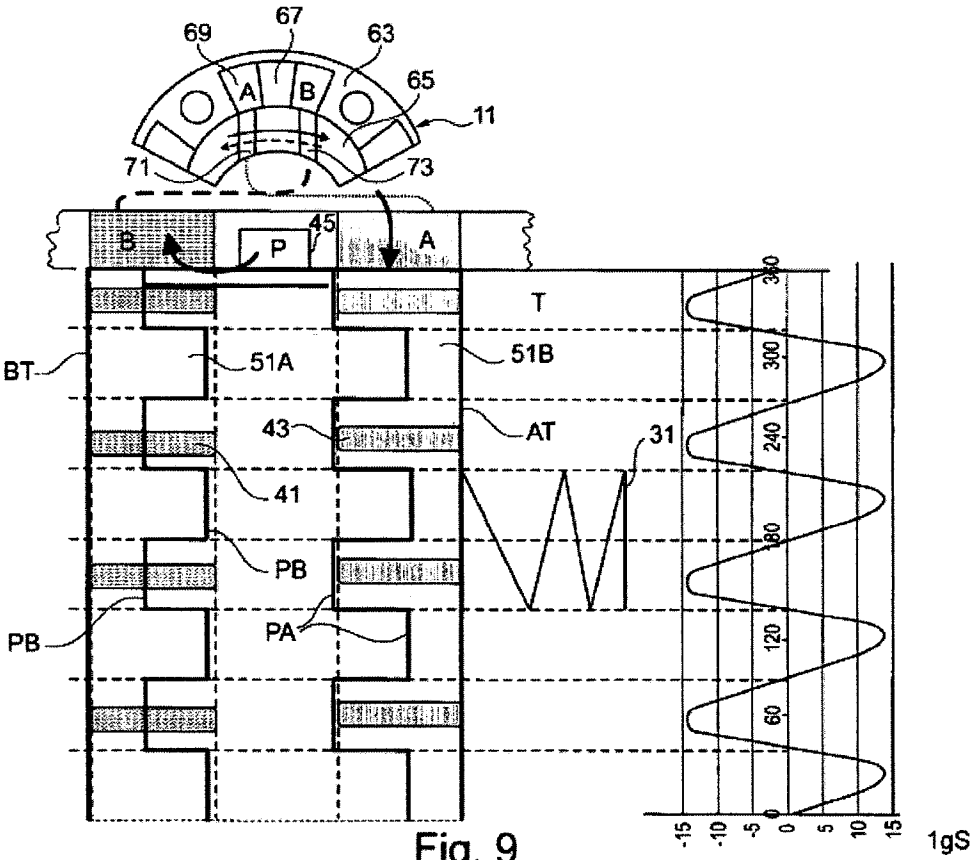
Figure 10:
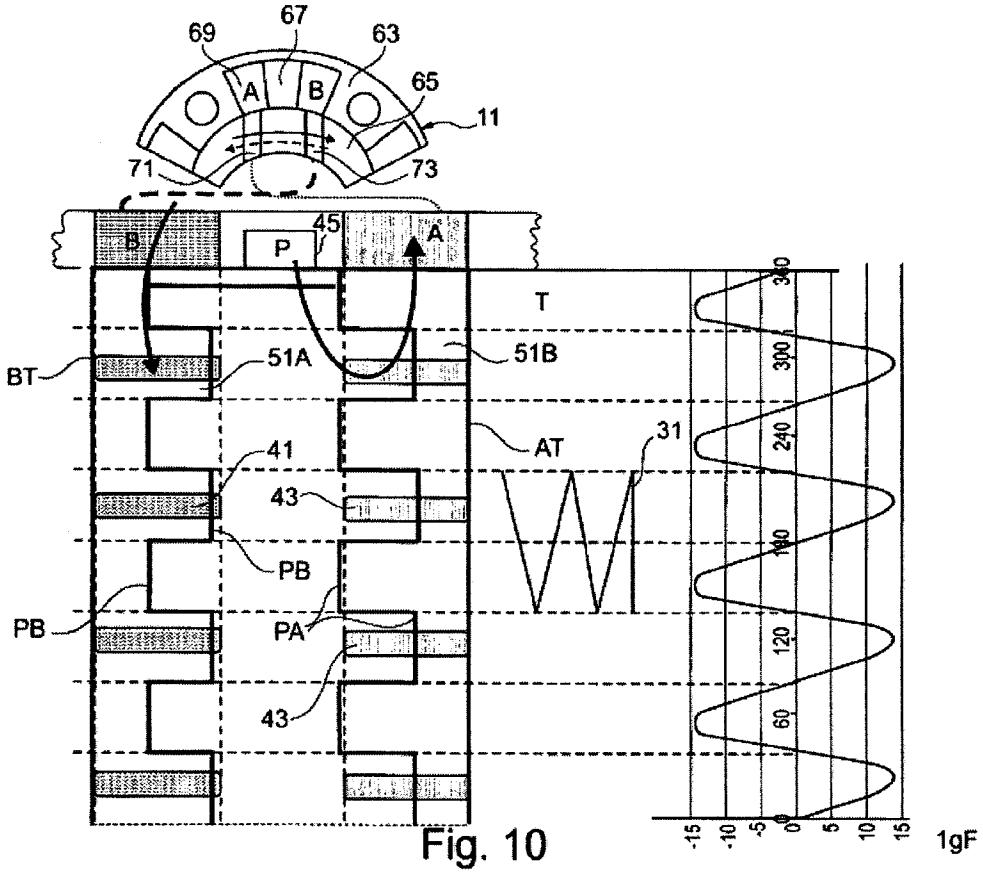

FIG. 9 shows an intermediate position in which, upon the occurrence of a retardation torque, the second orifices 43 are completely blocked. In this way, an adjustment is blocked. Correspondingly, FIG. 10 shows complete blocking of the first orifices 41 upon the occurrence of an advance torque. FIGS. 9 and 10 therefore depict an axial switching position of the valve piston 27 in which an adjustment of the camshaft 35 should be prevented, that is to say said camshaft should be held in a defined relative angular position with respect to the crankshaft.

FIGS. 5 to 10 show switching positions in which a high pressure of the pump P is available, that is to say generally an operating state of the internal combustion engine at high rotational speeds. If, however, the available pressure of the pump P is not high, in particular is considerably lower than the pressure exerted by camshaft torques, a suitable OPA method can be set through the selection of further switching positions. This will be described on the basis of FIGS. 11-14.

Figure 11:
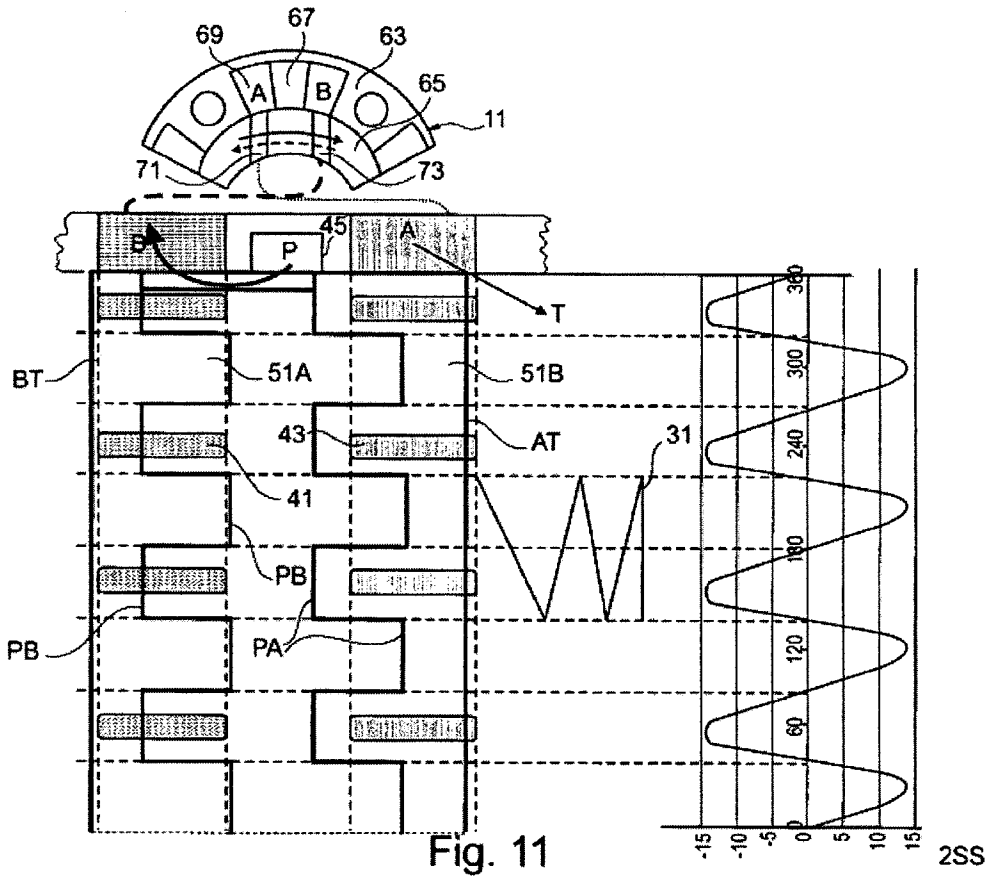
Figure 12:
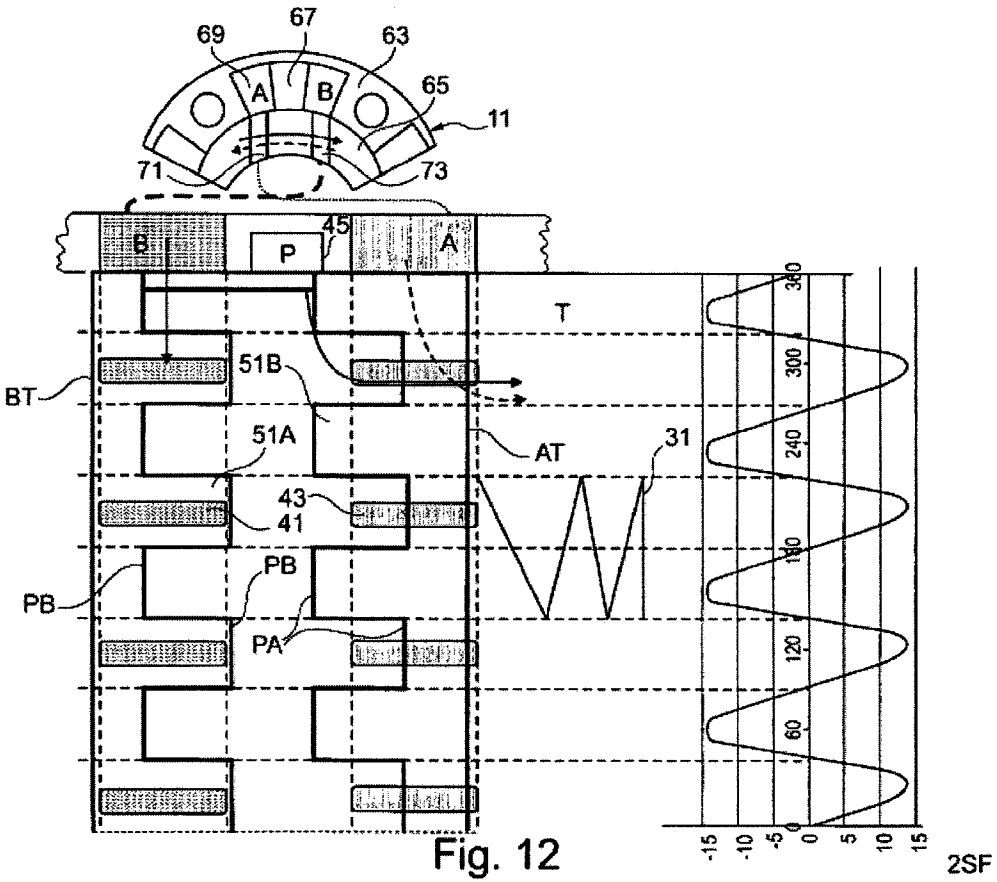

FIG. 11 corresponds to FIG. 5. It is thus sought to realize an adjustment in the "retardation" direction. Here, the retardation torque aids the adjustment. In FIG. 12, upon the occurrence of an advance torque, it is clear that, owing to the axial position of the valve piston 27 which has now changed in relation to FIG. 6, complete coverage of the first orifices 41 is attained. Whereas, therefore, in FIG. 6 only a high pump pressure was available for compensating the advance torque with the first orifices 41 slightly open, in the case of a low pump pressure the advance torque is suppressed by a complete blockage of the first orifices 41. FIGS. 13 and 14 again show the corresponding illustration in the case of an "advance" adjustment.

The switching positions illustrated above can thus be summarized as follows: two OPA adjustment methods are provided, one in the case of low pump pressure and one in the case of high pump pressure. The axial switching positions can be abbreviated as follows:

Switching position I: high pump pressure, retardation adjustment, FIGS. 5, 6

Switching position II: low pump pressure, retardation adjustment, FIGS. 11, 12

Switching position III: blocked adjustment, FIGS. 9, 10

Figure 13:
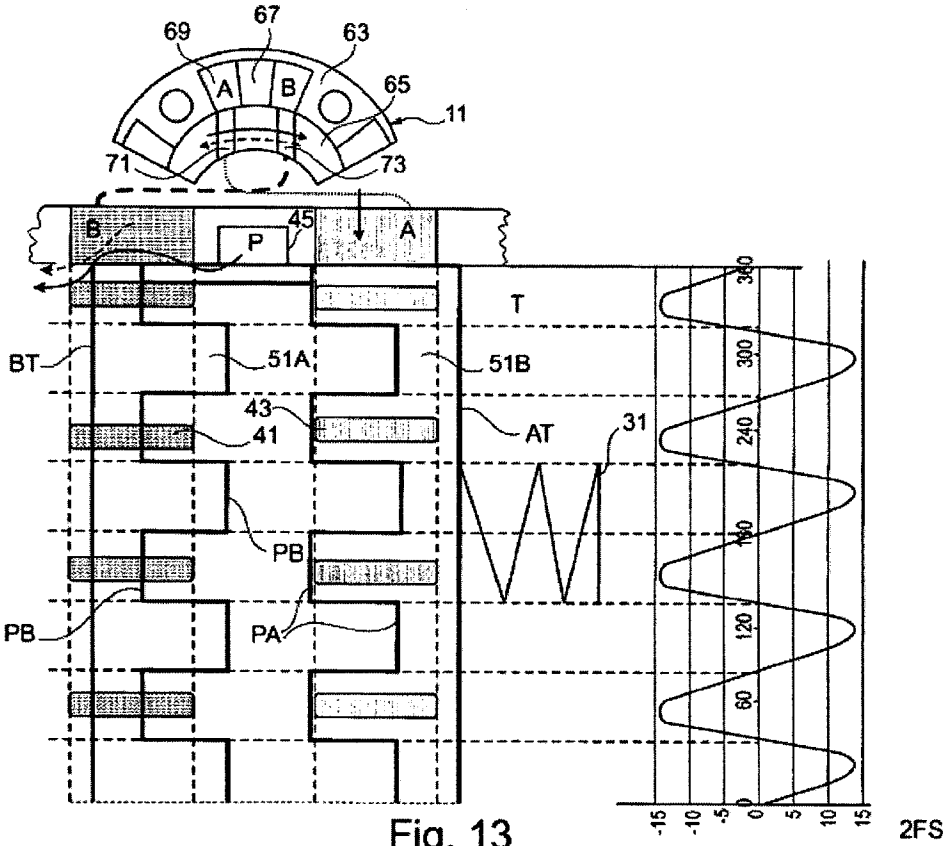
Figure 14:
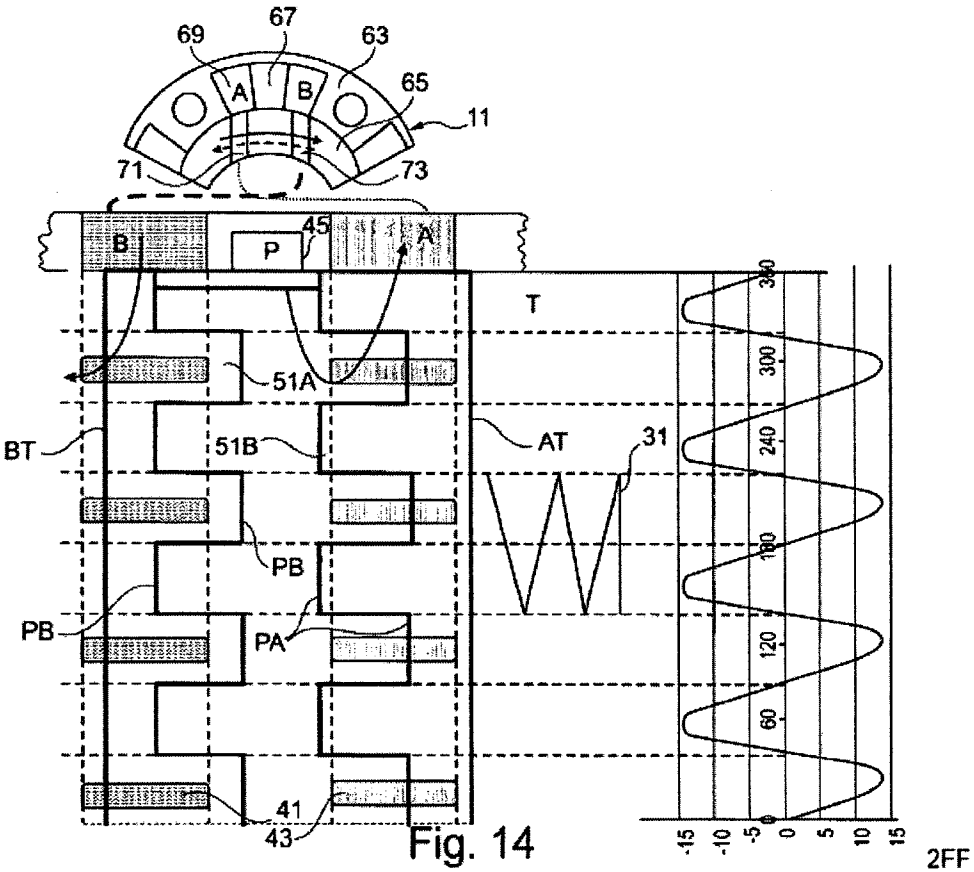

Switching position IV: low pump pressure, advance adjustment, FIGS. 13, 14

Switching position V: high pump pressure, advance adjustment, FIGS. 7, 8

The advantage of this adjustability lies in particular in the fact that, by means thereof, in the case of high pump pressure and a torque which counteracts the desired adjustment direction, the inflow openings 41 and 43 to the respective chamber parts A, B are not fully closed, as a result of which the pump power, which is higher than the relatively low camshaft torque, can nevertheless still be utilized for adjustment despite the oppositely acting camshaft torque. The times at which oppositely acting camshaft torques arise can thus be utilized for the adjustment, resulting in a fast adjustment. If, however, the pump power is lower than the camshaft torques, the oppositely acting torques are suppressed by means of the completely closed orifices 41 and 43, such that no reverse adjustment takes place.

Figure 15:
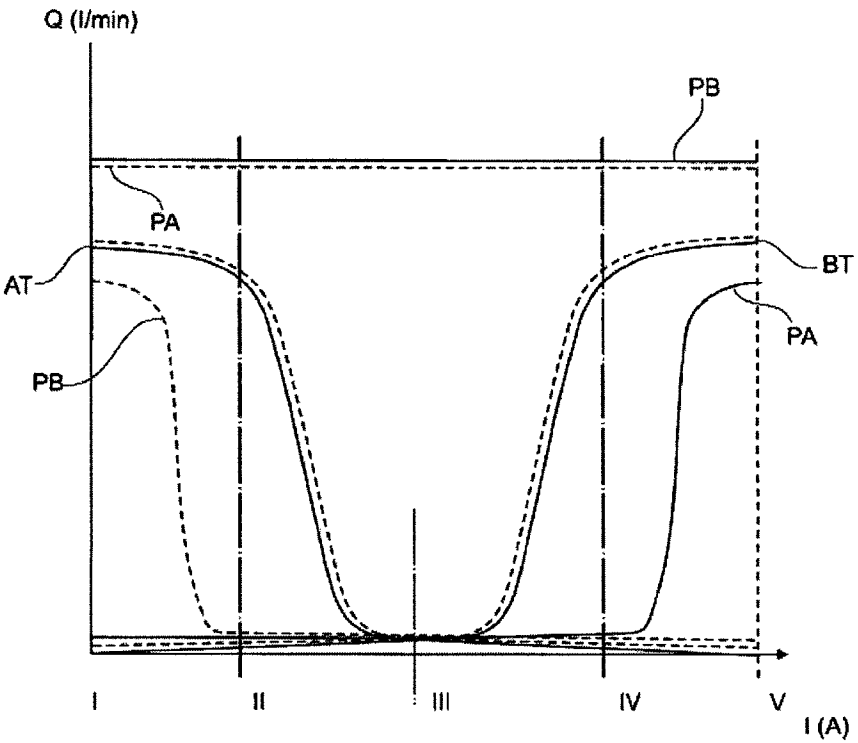
FIG. 15 is an illustration of the change in flow rates at different control edges as a function of the switching position in the OPA method.

FIG. 15 illustrates how the throughflow of pressure medium at the respective inner and outer edges PA, PB, BT, AT changes as a function of the switching position. Here, dashed lines illustrate profiles at times with a camshaft torque in the advance direction, and solid lines illustrate profiles at times with camshaft torques in the retardation direction. The line for the inner edge of the first cover part 51A, PB, will be explained by way of example: In the case of camshaft torques in the retardation direction, the throughflow at the inner edge PB is high in all axial positions, whereas in the case of torques in the advance direction, from switching position I to switching position II and subsequent switching positions, said throughflow falls quickly to zero.

Figure 16:
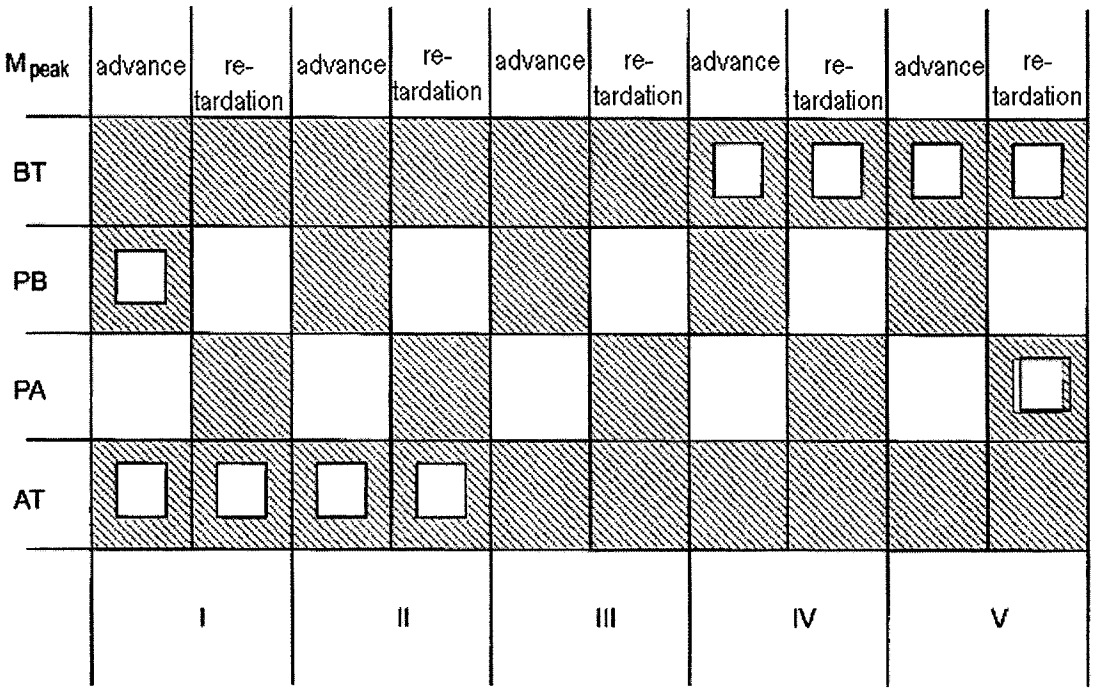
FIG. 16 is an illustration of the opening of the control edges as a function of the switching position in the OPA method.

FIG. 16 schematically shows, for switching positions I-V, the degree of opening of the orifices 41, 43 as viewed from the respective inner edges PB, PA and outer edges BT, AT as a function of the switching positions I-V and the adjusting direction. Fully hatched fields correspond to a completely blocked orifice 41, 43, fully white fields correspond to a completely open orifice 41, 43, and partially hatched fields correspond to a partially blocked orifice 41, 43.

The statements made up to this point relate to an adjustment method in which adjustment is carried out predominantly by means of the pressure provided by the pump P and in which pressure generated by camshaft torques has an assisting action in suitable switching positions. It is now sought below to describe, in addition to a pump mode of said type, a torque mode in which predominantly the pressure peaks generated by camshaft torques are utilized for adjustment, while the pressure provided by the pump P possibly assists the adjustment.

Figure 17:
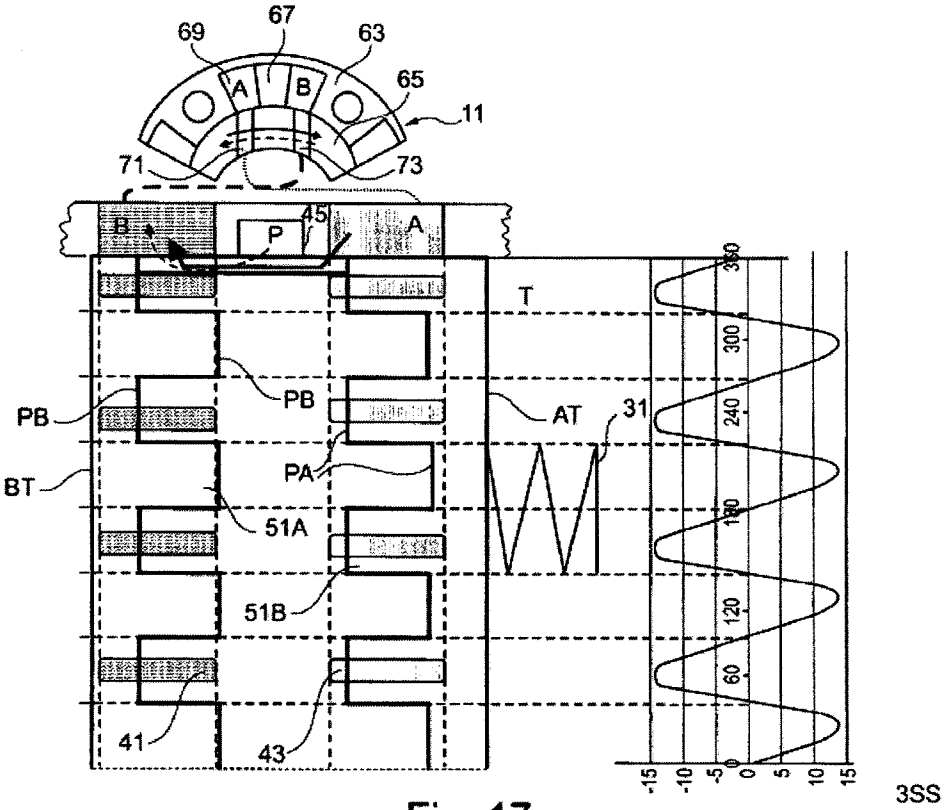
FIGS. 17-20 are schematic illustrations of the different switching positions in the case of a CTA method.

FIG. 17 shows an illustration corresponding to the illustrations of FIGS. 5-14, for the purpose of explaining a retardation adjustment by means of the utilization of the retardation torques. Here, the orifice cover 51 is set by means of the axial position of the valve piston 27 such that, upon the occurrence of a retardation torque, a connection of the two chamber parts A and B is created via the first and second orifices 41, 43. Here, the first orifices 41 are opened to a great extent, such that intense dethrottling, and therefore a low risk of air induction, are again attained. The second orifices 43 are opened to a small extent in order to realize discharge control from the first chamber part A. As a result of the camshaft torque which causes rotation in the retardation direction, a pressure peak is now built up which, by means of the different opening ratios of the first and second orifices 41, 43, generates a higher pressure in the first chamber part A than in the second chamber part B, and therefore, with a displacement of oil from the first chamber part A into the second chamber part B, causes a displacement of the vane 67 and therefore an adjustment of the camshaft 35 in the retardation direction. Oil from the pump P which arrives via the third orifices 45 assists said adjustment and compensates for leakage losses.

Figure 18:
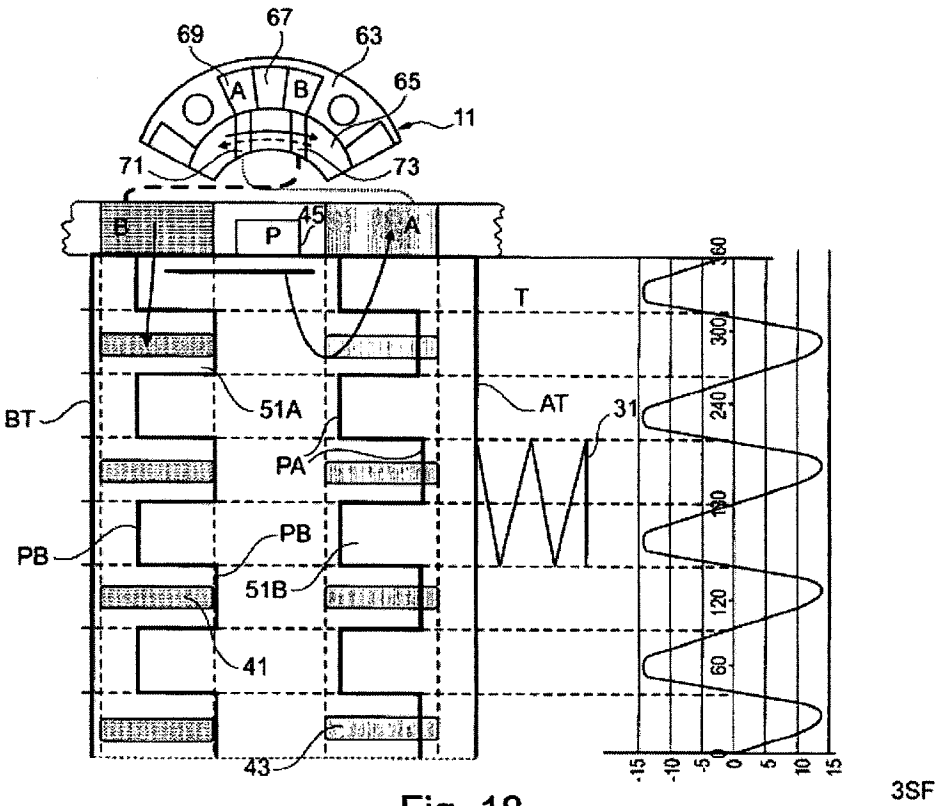

FIG. 18 shows the same axial switching position as FIG. 17, but here, the relative rotational position between the valve piston 27 and valve housing 29 has been changed, because now the camshaft 35 is in a rotational position in which an advance torque arises. Since it is still sought to realize a retardation adjustment (unchanged axial position of the valve piston 27), said advance torque must be suppressed with regard to its adjustment action. For this purpose, the first cover part 51A completely blocks the first orifices 41. Oil therefore cannot escape from the second chamber part B, and no adjustment takes place. The complete shut-off prevents a return swing. Via fully open second orifices 43, and therefore in an intensely dethrottled manner, the pump P pumps oil in an adjustment-neutral manner into the first chamber part A. Induction of air is prevented in this way.

Figure 19:
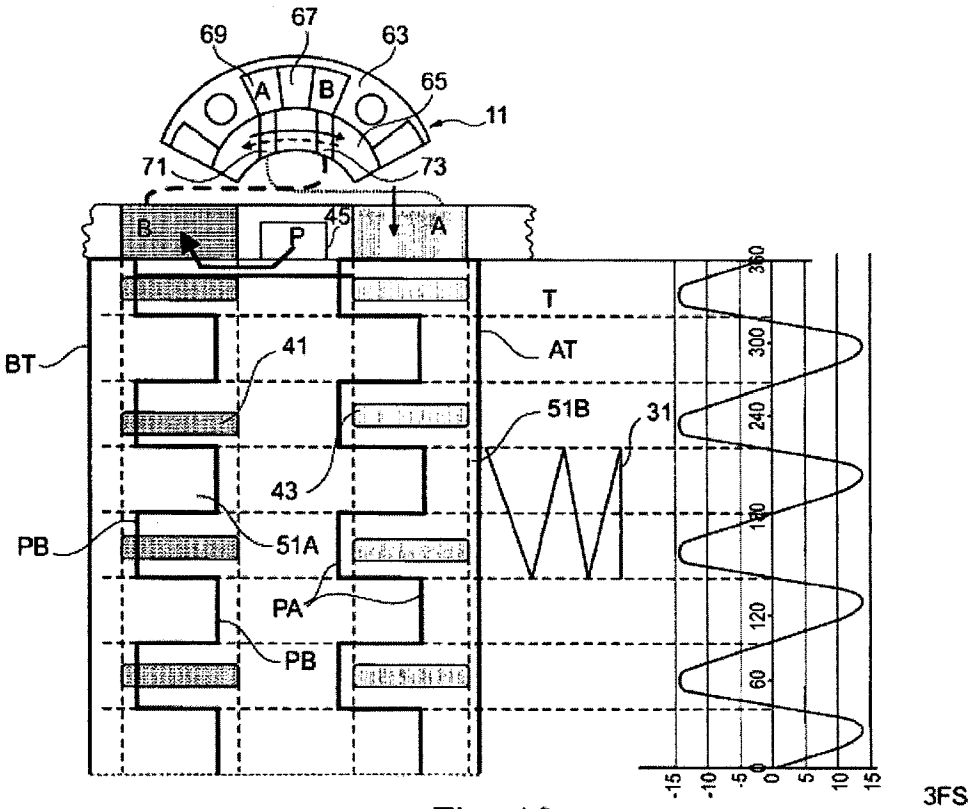
Figure 20:
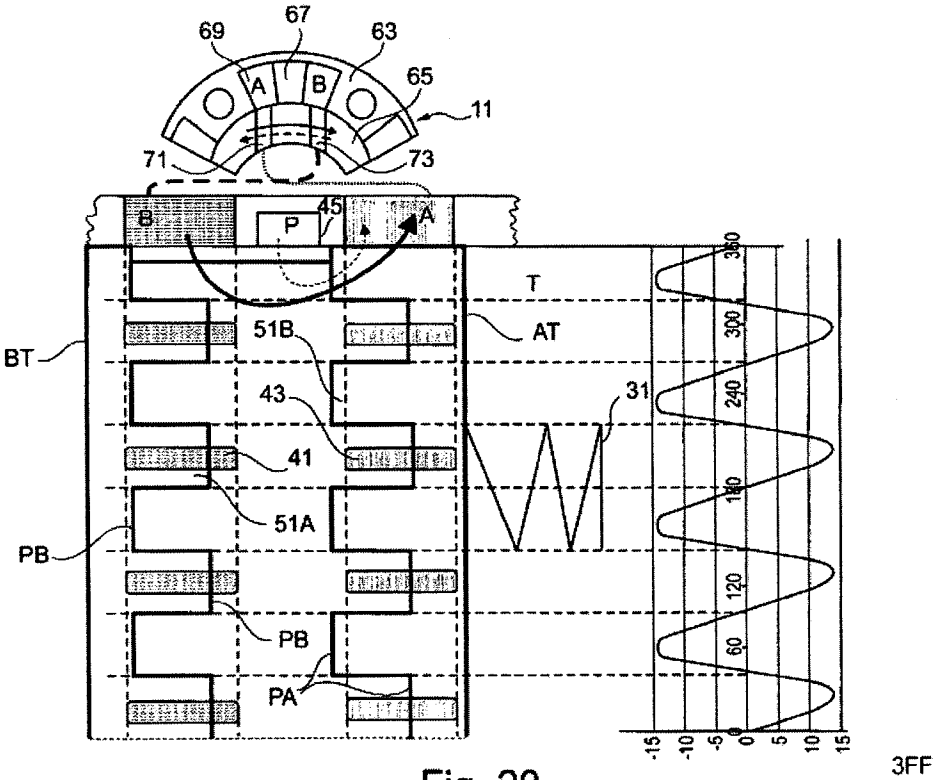

FIGS. 19 and 20 show positions corresponding to FIGS. 18 and 19, but for the opposite advance adjustment direction.

A particularly expedient sequence of switching positions can now be established by selecting axially successive switching positions as follows:

Switching position I: pump mode (OPA), retardation adjustment, FIGS. 5, 6

Switching position II: torque mode (CTA), advance adjustment, FIGS. 19, 20

Switching position III: blocked adjustment, FIGS. 9, 10

Switching position IV: torque mode (CTA), retardation adjustment, FIGS. 17, 18

Switching position V: pump mode (OPA), advance adjustment, FIGS. 7, 8

Figure 21:
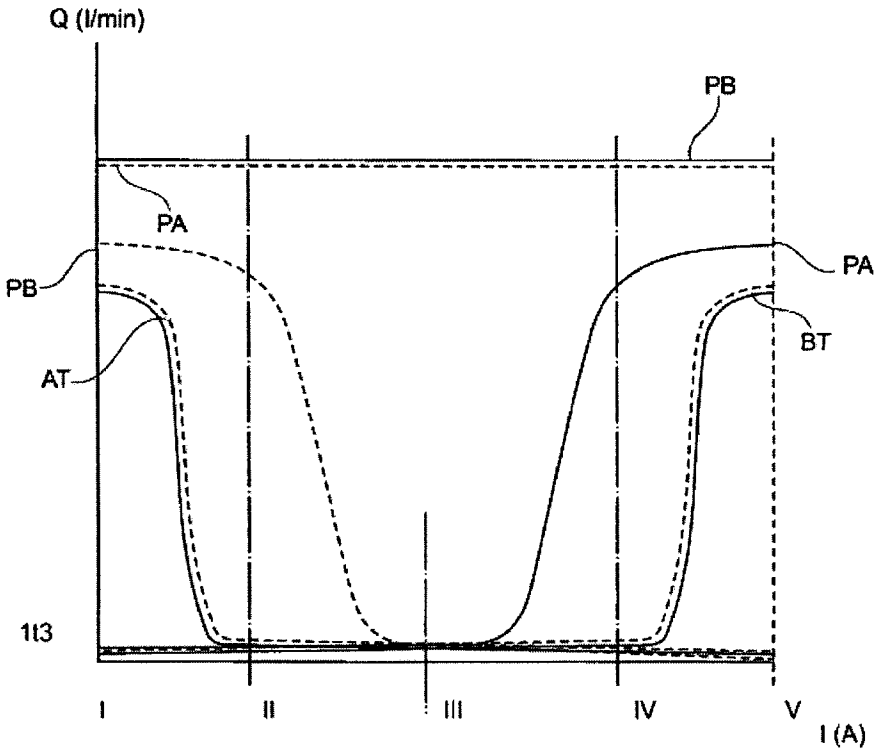
FIG. 21 is an illustration of the change in the flow rates at different control edges as a function of the switching position in the CTA method.

It is therefore possible, depending on the presence either of a dominating pressure of the pump P or of dominating camshaft torques for the camshaft adjustment, to set either a pump mode or a torque mode. FIG. 21 again illustrates, for said sequence of switching positions, how the throughflow of pressure medium at the respective control edges, that is to say inner and outer edges PA, PB, AT, BT varies as a function of the axial position of the valve piston 27 and of the valve housing 29, that is to say the switching positions I-V.

Figure 22:
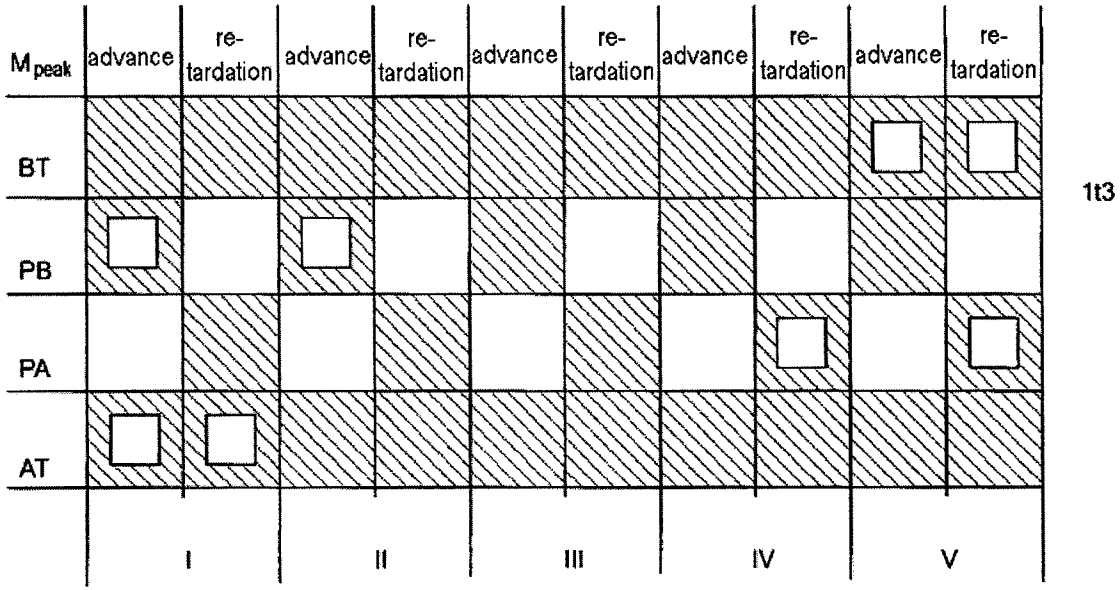
FIG. 22 is an illustration of the opening of the control edges as a function of the switching position in the CTA method.

FIG. 22 schematically shows, for the switching positions I-V, the degree of opening of the orifices 41, 43 as viewed from the respective inner edges PB, PA and outer edges BT, AT as a function of the switching positions I-V and the adjustment direction. Fully hatched fields correspond to a completely blocked orifice 41, 43, fully white fields correspond to a completely open orifice 41, 43, and partially hatched fields correspond to a partially blocked orifice 41, 43.

LIST OF REFERENCE SYMBOLS

1 Internal combustion engine

2 Crankshaft

3 Piston
4 Cylinder
5 Traction mechanism drive
6 Intake camshaft
7 Exhaust camshaft
8 Cam
9 Intake gas exchange valve
10 Exhaust gas exchange valve
11 Camshaft adjuster
12 Cylinder valve
20 Control device
21 Magnet
23 Magnet piston
25 Rotation prevention means
27 Valve piston
29 Valve housing
31 Restoring spring
33 Axial bearing arrangement
35 Camshaft
41 First orifices
43 Second orifices
45 Third orifices
51 Orifice cover
51A First cover part
51B Second cover part
52 Crown serrations
53 Valve piston surface
63 Stator
65 Rotor
67 Vane
69 Pressure chamber
71 First oil duct
73 Second oil duct
A First chamber part
B Second chamber part
P Pressure medium pump
T Tank
PA Inner edge of the second cover part 51B
PB Inner edge of the first cover part 51A
AT Outer edge of the second cover part 51B
BT Outer edge of the first cover part 51A

The invention claimed is:

1. A camshaft adjuster for a camshaft which serves to actuate cylinder valves of an internal combustion engine, wherein retardation torques in a direction of retarded cylinder valve opening times are imparted back to the camshaft adjuster by the camshaft when cams are running on, and oppositely directed advance torques in a direction of advanced cylinder valve opening times are imparted back to the camshaft adjuster by the camshaft when cams are running off, the camshaft adjuster comprising:

a pressure chamber and an adjusting member arranged in the pressure chamber, the adjusting member divides the pressure chamber into a first chamber part and a second chamber part, wherein pressure medium can be supplied to the first chamber part and the second chamber part and the pressure medium can be discharged from the first chamber part and the second chamber part, such that the adjusting member is movable by a pressure difference between the first chamber part and second chamber part, resulting in a rotation of the camshaft, wherein, when a relatively high pressure prevails in the first chamber part, the camshaft is rotated in the direction of advanced cylinder valve opening times, and when a relatively high pressure prevails in the second chamber part, the camshaft is rotated in the direction of retarded cylinder valve opening times, and wherein a supply and discharge of pressure medium is controllable by a control device, a torque mode or a pump mode can be selectively set by the control device, wherein in the torque mode, predominantly camshaft torques are utilized to build up pressure in the first chamber part or in the second chamber part, and in the pump mode, a pressure build-up in the first chamber part or in the second chamber part is realized predominantly by the pressure medium provided by a pressure medium pump, wherein the control device comprises a valve piston which is arranged in a valve housing, the valve piston is rotatable and axially displaceable relative to the valve housing, the torque mode or the pump mode is settable by axial relative displacement of the valve piston with respect to the valve housing, and the supply and discharge of the pressure medium to and from the first and second chamber parts is controllable by relative rotation of the valve piston with respect to the valve housing.

2. The camshaft adjuster as claimed in claim 1, wherein first orifices and second orifices are arranged in the valve housing so as to be distributed over a circumference of the valve housing, the first orifices correspond with the second chamber part and the second orifices correspond with the first chamber part, and a surface of the valve piston forms an orifice cover such that the first orifices and the second orifices can be at least partially closed off by the orifice cover in accordance with an axial position and an angular position of the valve piston relative to the valve housing.

3. The camshaft adjuster as claimed in claim 2, wherein the first orifices and the second orifices are arranged relative to one another on a circumference at an angular interval, in each case spaced apart uniformly, and arranged in a correct phase with respect to the orifice cover, such that a relative rotation of the valve piston with respect to the valve housing by the angular interval leads to a geometrically identical arrangement.

4. The camshaft adjuster as claimed in claim 2, wherein the orifice cover is formed from a first cover part for the first orifices and a second cover part for the second orifices, the first cover part and the second cover part have in each case an edge situated axially at an outside on the valve piston and an axially inner edge, and the inner edges have an approximately crown-like profile in a circumferential direction with an axial position which alternates along the circumference.

5. The camshaft adjuster as claimed in claim 1, wherein, for the relative axial position of the valve piston, five switching positions can be set, wherein in a first position, the pump mode is set for an adjustment of the camshaft in the direction of retarded cylinder valve opening times, in a second, axially subsequent switching position, the torque mode is set for an adjustment of the camshaft in the direction of advanced cylinder valve opening times, in a third, axially subsequent switching position, a camshaft adjustment is blocked, in a fourth, axially subsequent switching position, the torque mode is set for an adjustment of the camshaft in the direction of retarded cylinder valve opening times, and in a fifth, axially subsequent switching position, the pump mode is set for an adjustment of the camshaft in the direction of advanced cylinder valve opening times.

6. The camshaft adjuster as claimed in claim 5, wherein, in the first switching position, upon occurrence of retardation torques, a relative angular position of the valve housing and the valve piston is set such that the first orifices are predominantly opened up by the orifice cover for a supply of pressure medium from the pressure medium pump, while the second orifices are open for a discharge of pressure medium, wherein, upon occurrence of advance torques, a relative angular position of the valve housing and the valve piston is set such that the first orifices are opened up by the orifice cover for a supply of pressure medium from the pressure medium pump, while the second orifices are opened up for a supply of pressure medium from the pressure medium pump and simultaneously for a discharge of pressure medium.

7. The camshaft adjuster as claimed in claim 5, wherein, in the fourth switching position, upon the occurrence of retardation torques, a relative angular position of the valve housing and the valve piston is set such that the first orifices are predominantly opened up by the orifice cover for a supply of pressure medium from the second chamber part, while the second orifices are open for a discharge of pressure medium from the second chamber part into the first chamber part, wherein, upon the occurrence of advance torques, a relative angular position of the valve housing and valve piston is set such that the first orifices are blocked by the orifice cover, while the second orifices are substantially opened up for a supply of pressure medium from the pressure medium pump.

8. The camshaft adjuster as claimed in claim 5 wherein, in the second switching position, upon the occurrence of advance torques, a relative angular position of the valve housing and the valve piston is set such that the second orifices are predominantly opened up by the orifice cover for a supply of pressure medium from the first chamber part and the first orifices are open for a discharge of pressure medium from the first chamber part into the second chamber part, wherein, upon the occurrence of retardation torques, a relative angular position of the valve housing and the valve piston is set such that the second orifices are blocked by the orifice cover, while the first orifices are substantially opened up for a supply of pressure medium from the pressure medium pump.

9. The camshaft adjuster as claimed in claim 5 wherein, in the fifth switching position, upon the occurrence of advance torques, a relative angular position of the valve housing and the valve piston is set such that the second orifices are predominantly opened up by the orifice cover for a supply of pressure medium from the pressure medium pump, while the first orifices are open for a discharge of pressure medium, wherein, upon the occurrence of retardation torques, a relative angular position of the valve housing and the valve piston is set such that the first orifices are opened up by the orifice cover for a supply of pressure medium from the pressure medium pump and simultaneously for a discharge of pressure medium, while the second orifices are opened up for a supply of pressure medium from the pressure medium pump.

* * * * *